US006766754B1

(12) United States Patent
Scott

(10) Patent No.: US 6,766,754 B1
(45) Date of Patent: Jul. 27, 2004

(54) BALLAST EXCHANGE SYSTEM FOR MARINE VESSELS

(75) Inventor: Thomas J. Scott, Dhahran (SA)

(73) Assignee: Saudi Arabian Oil Co., Dhahran (SA)

( * ) Notice: Subject to any disclaimer, the term of this patent is extended or adjusted under 35 U.S.C. 154(b) by 0 days.

(21) Appl. No.: 10/617,957

(22) Filed: Jul. 10, 2003

Related U.S. Application Data

(60) Provisional application No. 60/405,512, filed on Aug. 23, 2002.

(51) Int. Cl.[7] ..... B63B 39/03

(52) U.S. Cl. ..... 114/125; 114/74 R

(58) Field of Search ..... 114/74 R, 121, 114/122, 125

(56) References Cited

U.S. PATENT DOCUMENTS

| | | | | |
|---|---|---|---|---|
| 2,984,200 A | | 5/1961 | Toussel | 114/121 |
| 3,285,216 A | | 11/1966 | Field et al. | 114/122 |
| 3,286,677 A | | 11/1966 | Hillliard | 114/125 |
| 3,757,813 A | * | 9/1973 | Levenberg | 137/172 |
| 3,797,440 A | | 3/1974 | Pangalila | 114/125 |
| 6,029,595 A | | 2/2000 | Bachmann | 141/125 |
| 6,053,121 A | | 4/2000 | Tamashima et al. | 114/125 |
| 6,125,778 A | | 10/2000 | Rodden | 114/74 |
| 6,694,908 B2 | * | 2/2004 | Parsons | 114/125 |

* cited by examiner

*Primary Examiner*—Jesus D. Sotelo
(74) *Attorney, Agent, or Firm*—Abelman, Frayne & Schwab

(57) ABSTRACT

A method and apparatus for replacing existing ballast water in the ballast tanks of a ship while the ship is underway in the sea utilizes a seawater inlet port in the bow of the ship that admits water when the ship is moving to produce a pressure that is greater than the pressure of the ballast water that is to be replaced, with the incoming seawater from the inlet port being directed into the bottom portion of the ballast tanks where it rises to displace the existing ballast water from outlet ports located in a top portion of the ballast tanks.

25 Claims, 4 Drawing Sheets

BALLAST EXCHANGE SYSTEM FOR MARINE VESSELS

This application claims the benefit of Provisional application No. 60/405,512, filed Aug. 23, 2002.

FIELD OF THE INVENTION

This invention relates to methods and apparatus for controlling the intake, exchange and discharge of seawater ballast from marine vessels such as VLCC, container ships, oil tank ships and the like.

BACKGROUND OF THE INVENTION

In order to maintain the stability and safe operation of an empty or partially loaded marine cargo vessel, it is necessary to add seawater to the ballast tanks to trim the vessel and/or to attain a predetermined draft.

In many instances, cargo vessels take on seawater as ballast in a first port, transport the seawater as ballast many thousands of miles to a second port where cargo is loaded and the seawater ballast discharged into the local harbor or mooring site. It has been well documented that seawater ballast loaded at one location can contain a variety of living organisms ranging from microscopic bacteria to marine plants, fish, crustaceans and other marine life that can have a negative ecological impact when discharged into the local waters at the port of call. Although some efforts have been undertaken to reduce this problem by providing at least a crude filtration system to prevent the intake of rodents, fish, crabs and the like, these efforts have not been particularly effective.

Large volumes of water must typically be introduced into the vessel's ballast tanks and the loading must be done as quickly as possibly due to the large demurrage fees associated with the inefficient loading or idling of commercial marine vessels. Improved methods and apparatus are needed to eliminate or substantially reduce the adverse effects associated with current marine shipping practices that transport and discharge at remote locations large volumes of water that can contain biological and marine life that can have an adverse impact on the marine ecology at the point or points of discharge.

A method and apparatus that includes a bow intake conduit and that utilizes the difference in hydrodynamic pressure for effecting an exchange of water in ballast tanks while the ship is underway is disclosed in U.S. Pat. No. 6,053,121. Pressurized fresh seawater from a main conduit containing fresh seawater is introduced at the bottom of one end of a ballast tank and a valved bottom drain at the opposite end of the ballast tank discharges the water through the underside of the hull into the sea. As disclosed in the '121 patent, based upon laboratory experimental data, after six hours of operation of a small-scale system, a salt water solution in the primary tank was diluted to 25% of its original salt content. There is no suggestion or teaching in the disclosure of the '121 patent that water in the ballast tank should be discharged through a port or outlet at the top of the ballast tank, nor does it disclose the desirability of the removal of biological marine life from the ballast tank.

It is therefore an object of this invention to provide a method and apparatus for rapidly exchanging seawater ballast from marine vessels that eliminates or greatly reduces the transport of the original ballast over great distances from the origin of the ballast, along with the marine organisms entrained therein.

It is a further object of this invention to provide an efficient and economical apparatus for introducing and discharging seawater ballast into the ballast tanks of a marine vessel while the vessel is underway.

Yet another object of the present invention is to provide a method and apparatus that permits the ready control of the volume of seawater ballast, as well as its position in any one or more ballast tanks in the vessel, while minimizing the utilization of pumps and power that must be provided while the vessel is underway.

SUMMARY OF THE INVENTION

The above objects and other advantages are achieved through the apparatus and method of the invention in which water is continuously admitted through at least one opening in the bow of a ship and transmitted through one or more main conduits communicating with the bow opening for distribution into the bottom of a ballast tank to displace existing ballast water upwardly through the tank and discharging the ballast water into the sea through one or more overflow discharge ports or outlets that are positioned at an upper-most point of the ballast tank as close to the shear strake as possible.

As the ship advances, the seawater is admitted through the one or more bow openings and is distributed into the lower regions of the ballast tanks and rises to overflow through the discharge ports in each of the ballast tanks to which it has been admitted. The overflow is discharged into the sea. The greater the ship's forward speed, the greater will be the volumetric flow of water through the main conduit(s) and thereafter through the ballast tanks and discharge ports.

In a particularly preferred embodiment, two bow openings are provided, each opening is provided with at least one valve communicating with a main conduit and each conduit has valved outlets that extend to or through each of the plurality of ballast tanks along the length and on either side of the centerline keel. At least one inlet T-fitting or branch line is provided to introduce fresh sea water from the main conduit into the bottom or lower region of the respective ballast tanks.

In a further preferred embodiment, a plurality of inlet openings to each ballast tank are provided from the main conduit to maximize the flow and distribution of incoming seawater to all of the lower regions of the ballast tank in order to facilitate the flushing effect and the replacement of existing ballast water. The positions of the multiple inlet openings are selected based upon the existing bulkheads, stringers, baffles and structural elements inside each of the ballast tanks.

In another preferred embodiment of the apparatus and method of the invention, each of the T-fittings to the ballast tank is provided with at least one, but most preferably two sequential valves that are controlled by hydraulically-operated actuators. The valves are positioned between the main conduit and any discharge of suction bellmouth(s). The use of two valves in series provides an added margin of safety in the event of a malfunction or blockage in one of the valves. The operation of the hydraulic actuators is preferably directed from a control panel located in the cargo control room, bridge and/or another operations area of the ship. As a further safety precaution, manually operable valve positioners can also be provided for each valve.

The installation of at least two valves at the one or more bow intake openings is also preferred. In order to protect the valve from impact with submerged debris, a high-strength intake guard, such as a grid of steel or stainless steel bars can be provided. The primary control valve for admitting seawater is preferably a ball valve with a hydraulic actuator.

Behind the ball valve is preferably installed a double gate valve, also fitted with a hydraulic actuator. The bow openings can optionally be fitted with one or more hydraulically-operated doors or covers. In the event of an accidental failure of the hydraulic power system, the bow doors fail-safe to the closed position. The intake valves are also constructed to return to their closed position in the event of a power failure.

The apparatus and its method of operation differs from the prior art in which the intake ports for the ballast water are typically located at the rear of the ship in the vicinity of the pump room. As will be appreciated by those of ordinary skill in the art, a considerable amount of energy is required to power the pumps in view of the large volume of water that must be displaced. Moreover, the prior art systems and methods of operation provide only for the dilution of the water that has been drawn into the ballast tanks during the unloading of the ship. This limitation of the prior art is overcome by the present invention where the ballast water is displaced upwardly to be discharged from the top of the tanks, rather than the bottom of the tanks as in the prior art.

The introduction of fresh seawater into the bottom section of the ballast tank with a minimum of mixing causes the volume of water originally present in the tank to move upwardly, caring with it the biological matter and marine organisms that were drawn into the tanks when they were filled. The invention thus provides a highly efficient means of flushing the existing ballast water from the tanks and replacing it with fresh ballast water.

As will be understood by those of ordinary skill in the art, it may be necessary to use existing pumps to provide sufficient ballast to initially move a very large crude carrier ("VLCC") from its unloading dock or mooring. However, once the ship is underway, its forward movement establishes a hydraulic force against the bow which, even at moderate speeds, is sufficient to lift the seawater in the ballast tanks. The hydraulic force can be calculated based upon the established relationship:

$$\text{Drag (lbs/sqft)} = \tfrac{1}{2} d v^2 k \quad (1)$$

where, d=density of the fluid, e.g., seawater;

v=relative velocity of vessel in water; and k=drag coefficient, assumed to be 1.28.

Table I below indicates the head of water, or water column, that can be raised at various relative velocities and pipe diameters.

TABLE I

Water column height due to vessel's speed in knots

| Speed (Kts.) V | Drag Coeff. K | Water Column Raised (feet) |
|---|---|---|
| 16 | 1.28 | 415 |
| 14 | 1.28 | 318 |
| 12 | 1.28 | 234 |
| 10 | 1.28 | 162 |
| 8 | 1.28 | 104 |
| 6 | 1.28 | 58 |

From Table I, it can be seen that at a relative speed of fourteen (14) knots is sufficient to lift a head of water up to 318 feet. This hydrodynamic force is sufficient to move the admitted seawater through the bow valves, main conduit or conduits, ballast tank T-fittings, branch lines, valves and interior bulkheads, baffles or piping, and to lift the water in the sidewall portion of the ballast tanks to overflow through the tank exit ports.

As will also be understood by one of ordinary skill in the art, the individual valves provided at the T-fittings in each of the ballast tanks can be adjusted to ensure an approximately equal through-put to each of the ballast tanks. For example, absent any flow controls imposed on the incoming ballast water, the stern ballast tanks may receive water at a hydraulic pressure that is effectively lower than that of the rust bow tank due to frictional flow losses. In order to ensure that a sufficient flow reaches the stern-most tanks to effect a continuous overflow, the forward inlet or overflow discharge valves can be partially closed to create a back pressure which will eventually be felt in the stern tanks. Other alternative modes of operation include reducing the diameter of the main conduit from bow to stem and/or reducing the diameter of the inlet pipes to the bow ballast tanks to restrict the flow forward, while providing larger diameter T-fittings and or inlet piping aft.

In a further preferred embodiment, the flow of incoming seawater to one or more ballast tanks can be reduced or shut-off entirely when the ship is moving at speeds that produce a relatively lower hydrodynamic force. In this mode of operation, incoming water can be directed to one or a group of tanks in order to achieve a complete flushing and replacement of water. After the first one or group of tanks have achieved the desired degree of exchange, the flow is decreased and/or entirely shut-off to those tanks in favor of another one or group of tanks. As the ship's speed and the associated hydraulic pressure increases, the exchange rate for individual tanks also increases.

In one preferred embodiment of the practice of the invention, a vessel that is provided with the ballast loading and discharge apparatus of the invention is loaded with the minimum amount of seawater ballast required to trim the vessel and permit its safe movement from a moored or docked location. After the vessel has moved away from its mooring position and gathers speed, one or more bow doors are opened to expose the inlet port or ports. Associated bow valves are opened to permit entry of additional seawater that is directed by control valves from the intake main to branch lines and the ballast tanks are filled to the predetermined desired level. Once the desired volumes of seawater ballast has been loaded and while the ship is still underway, ballast discharge valves are opened and the ballast in the tanks is discharged in a steady-state or equilibrium flow of input and discharge. In this practice of the method, the ballast water continuously circulates from an intake at the bow through the tanks and is discharged back into the sea. The flow will continue harmless to the vessel and its structure provided the overboard valves are left open at all times. In this way, the invention avoids the current practice of loading and transporting ballast water containing local marine life from one location to a port that may be many thousands of miles away.

The method can be continued during the voyage so that exchange is continuous. Alternatively, the ballast can be maintained during most of the voyage and the exchange stated when the vessel is closer to the destination, but still at sea. The exchange will then bring local marine life into the ballast tanks, and any necessary discharge thereof in port will not have an adverse ecological effect.

In the event that speed limitations, ocean currents, height of waterline requirements, piping restrictions due to the ships pre-existing configuration, and the like do not provide sufficient pressure to effect a complete exchange, auxiliary ballast water pumps can be employed in the practice of the invention.

As will be understood from the above description, the invention provides for various modes of operation when the ship is underway. These modes will depend upon the relative speed at any given time, and also on the rate of change of the speed with respect to the sea through which the ship is moving.

The use of conventional instruments that are adapted for use in the method and with the apparatus of the invention will provide a means for visually displaying the condition of each of the ballast tanks and the extent to which the original ballast water has been exchanged with the seawater through which the ship is moving.

As will be apparent to one of ordinary skill in the art, the entire system can optionally be controlled by an appropriately programmed general purpose computer. Using calibration data obtained empirically and/or by theoretical calculations, the times and rates of exchange at various flow rates are determined for a number of different velocities of the ship relative to the water at the bow intake(s). Flow meters at different positions along the centerline pipelines or main conduits are preferably installed provide accurate data in real time, thereby permitting automatic, programmed adjustments of individual valves, or groups of valves in response to changing conditions.

Programs can include exchange on a first-in, last-out basis, or vice-versa; or on an equal flow and exchange in all ballast tanks simultaneously; or on any ad hoc order selected by the operator at the start of the ship's departure from the unloading facility.

Flow meters can also be installed at the overflow points to provide information in real time to the control panel to indicate the relative rate of exchange of water in each of the ballast tanks. The hydraulic actuators can be utilized to adjust the flow rate through successive valves until the desired balance is obtained. An appropriately programmed general purpose computer can be utilized to make these corrections automatically.

Additional instrumentation can include temperature sensors located at the bow intake for the incoming seawater, at the overflow ports and at one or more positions in the ballast tanks. Since the temperature of the water held in the ballast tanks will be different, i.e., warmer or colder than the incoming seawater, the temperature differential information can also serve to indicate the extent of the exchange. For example, when the temperature of the overflow and incoming seawater are the same, or substantially the same, the exchange will be completed.

The rate of flow through the respective ballast tanks can also be controlled by adjusting valves at the overflow fittings. This may be less desirable, since an internal pressure is created in addition to the static pressure of the head of water in the ballast tanks.

From the above, it will be understood that the exchange of ballast is essentially continuous so long as the ship is moving at a sufficient speed to establish the required hydraulic pressure and the bow openings are admitting fresh seawater through the main conduits. In this way, marine organisms peculiar to one locale will be mixed with seawater as soon as the ship is underway and completely displaced from the ballast system by the flushing action within three volumetric exchanges.

The ballast tanks can also be provided with baffle plates and diverters that direct the incoming water to flush corners and/or other internal portions that might otherwise retain existing stagnant ballast. Efficient flushing can also be effected by nozzles and/or manifold outlets in piping connected downstream of the T-fitting and/or inlet valves.

The flow rate of ballast exchange water is dependent upon a number of factors including the speed of the ship relative to the water through which it is moving, the diameter of the main conduit and the diameter of the respective inlet T-fittings and piping through which water from the main conduit is admitted into each of the ballast tanks. In many large tankers, the ballast tanks extend about six feet between the outer hull plates and the inner walls of the tanks. Ample space is thus provided for installation of one or more main conduits on each side of the center keel dividing wall. The combined or total area of the tank's upper overflow or discharge outlets should be at least equal to the total area of inlet piping at the bottom of the tank in order to minimize back pressure due to flow restrictions.

In one preferred embodiment, a single main conduit approximately 20 inches in diameter extends from each of the port and starboard bow openings to the stern-most ballast tanks. A single 10-inch branch line T-fitting is provided along the main conduit to each of the ballast tanks. The overflow outlet is also preferably a 10-inch diameter or larger pipe with appropriate external flange fittings that is positioned at proximate the top of the ballast tank. In accordance with conventional design, the ballast tanks are also fitted with air vents.

Should it become necessary to close the bow valves, the ballast will be retained in its respective tanks. Auxiliary piping, such as that is conventional in current ships can be provided should it become necessary to reduce the ballast in one or more of the tanks. In one preferred embodiment, a ship that is already commissioned with conventional conduits and pumps is retrofitted by providing one or more bow intake openings and extending the existing piping from the bow ballast tanks to connect to the bow openings and valves. This method permits ships of current design and construction to be retrofitted to take advantage of the cost savings and ecological benefits of the invention.

BRIEF DESCRIPTION OF THE DRAWINGS

The invention will be described below in further detail and with reference to the attached drawing sheets in which like elements are referred to by the same number, and where.

DETAILED DESCRIPTION OF PREFERRED EMBODIMENTS

Figure 1:
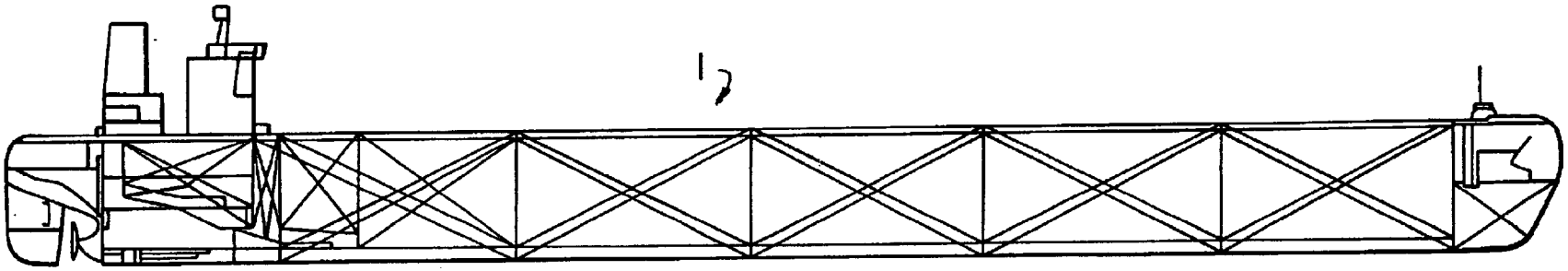
FIG. 1 PRIOR ART
FIG. 1 is a side elevation view of a marine crude carrying vessel of the prior art illustrating a typical construction.

Referring to the drawings, FIG. 1 is a side elevation of a typical cargo vessel of the prior art, the forward portion providing the cargo holds, with the engine, pump room and other mechanicals in the aft portion of the hull.

Figure 2:
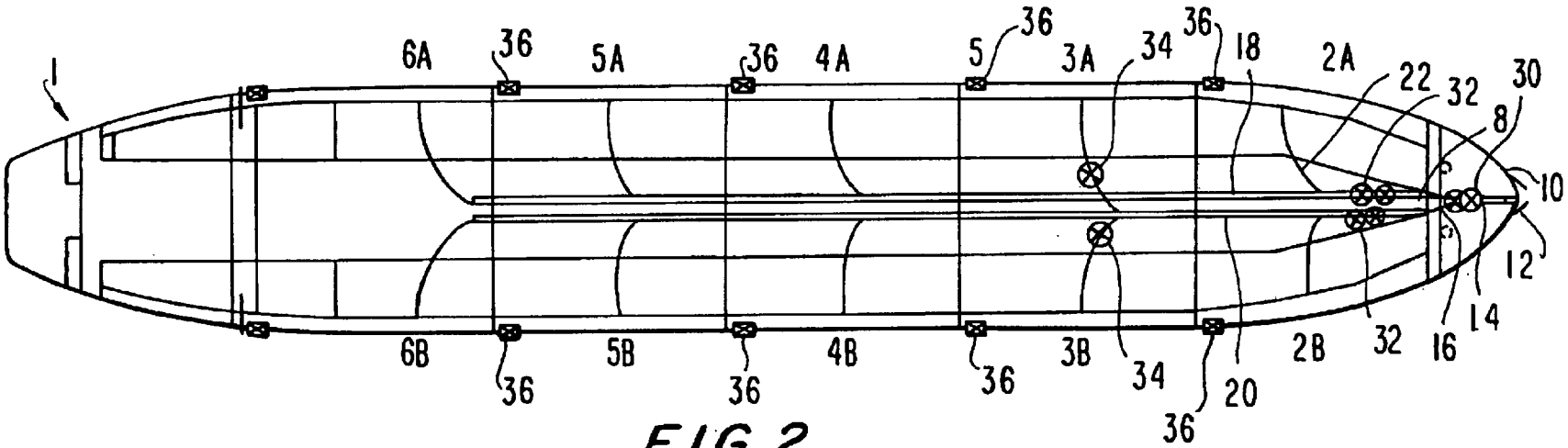
FIG. 2 is a top plan view of a marine vessel similar to that of FIG. 1 equipped with one embodiment of the invention.

An embodiment of the apparatus and method of operation of the invention is illustrated in FIG. 2 which depicts, in plan view, a typical crude oil tanker 1 having a plurality of port and starboard ballast tanks 2A, 2B through 6A, 6B. In accordance with standard marine construction, the tanker has a centerline bulkhead 8 extending from the bow 10 towards the stern. The positioning of the bow and aft superstructure and engine room of a typical vessel of the prior art is shown in the side elevation view of FIG. 1.

In accordance with the invention, the vessel's bow is fitted with one or more hydraulically operated doors 12 which, when open, permit water to flow into at least one intake conduit 14. In a preferred embodiment, seawater intake 14 is split at a Y-fitting 16 into port and starboard conduit mains 18 and 20, respectively, which extend down either side of centerline bulkhead 8 to provide fresh seawater for ballast exchange to each of the port and starboard ballast tanks.

Each of the port and starboard ballast tanks are joined to a respective port or starboard main conduit 18, 20 by at least one branch line T-fitting, referred to generally as 22. The feedlines 22 are joined to the main conduits 18, 20 by takeoff fittings that will minimize frictional losses as the water changes direction from its longitudinal path along the keel line to a generally transverse flow to be delivered to the individual ballast tanks positioned along the hull. In a preferred embodiment, the transverse feedlines 22 terminate in a bellmouth having a plurality of outlets that are positioned to direct the incoming exchange seawater to reach the entire bottom area or volume of the ballast tank in order to mix with the existing stored ballast and dislodge and keep in circulation any marine life so that it will be flushed from the top of the tank as the exchange is completed. The bellmouth can take the form of a plurality of branched pipes which enter the bottom of the respective ballast tanks through separate fittings. Alternatively, the manifold can take the form of a pipe having only one point of entry through the tank wall that is provided with a plurality of outlets that is secured to the bottom interior wall of the ballast tank.

Each ballast tank along the hull is provided with at least one discharge overflow outlet or port 37 proximate the top of the exterior wall. This discharge port 37 communicates through an opening in the exterior hull of the ship, thereby allowing the ballast water to be discharged into the sea. The hull can be provided with an appropriate fitting to direct the water outwardly away from the side of the ship to minimize the amount of ballast water that will run down the exterior painted hull. Conduits carrying pressurized sea water with appropriately valved fittings can also be provided in the vicinity of the ballast discharge overflow ports to wash the exterior surface of the hull to remove any dirt, marine life or the like that may have accumulated on the hull as a result of the discharge of stagnant ballast water.

In order to control the flow of incoming seawater during the ballast exchange process and to maintain the ballast in the tanks at the end of the process, primary and secondary backup valves are provided in accordance with current marine safety standards and regulations. Intake conduit 14 at the bow of the ship is provided with a pair of gate or glove valves 30, and each of the port and starboard main conduits 18 and 20 are each provided with a set of two butterfly segregation valves 34 for each of the tank feeder lines 22. The discharge or overflow ports for each of the ballast tanks are preferably provided with a pair of butterfly valves 36. The back-up valves for where the discharge ports should be positioned as close to the deck of the ship as possible.

In the method of operation of the invention, the bow door(s) 12 are opened and the hydraulic pressure in the upstream end of conduit 14 is measured and noted using appropriate instrumentation while the ship is underway. Once the hydrodynamic pressure has achieved the predetermined minimum to initiate ballast exchange, overflow valves 36 are fully opened and one or more of valve sets 34 are opened to admit water to port and/or starboard main conduits 18 and 20. Ballast exchange in one or more of the port and/or starboard ballast tanks is commenced by opening valves 22 in a predetermined sequence. For example, before the ship reaches its maximum relative velocity with respect to the sea through which it is moving, the relative hydrodynamic or hydraulic pressure differential may not be sufficient to permit the overflow of all of the ballast tanks. Using information derived from pressure gauges on the main conduits 18 and 20 and on each of the transfer feedlines 22, fresh seawater is admitted to one or more tanks to begin ballast exchange. The volumetric flow rate through transfer lines 22 is monitored using conventional instrumentation until the predetermined desired amount of fresh seawater has been passed into and through the respective ballast tanks.

Utilizing an appropriately programmed general purpose computer, the data relating to differential pressures and flow rates at relevant positions on each of the main conduits and individual ballast tank feed lines is collected and entered to provide the operator with information relating to the rate of exchange of ballast water, time required to completion and a completion signal. Automatic valve controllers are also programmed to respond to pressure and flow rate data points so that when one or more ballast tank exchanges have been completed, feed valves 34 are closed and ballast tank overflow valves 36 are closed when the system has stabilized.

As the relative velocity of the ship through the surrounding seas increases the hydrodynamic pressure in the main conduits 18 and 20 to a level sufficient to effect exchange in additional ballast tanks, an appropriate number of valves 34 and 36 for the respective tanks to be exchanged are opened. The operator or, optionally, the programmed general purpose computer, also controls the position of intake valves 30 in the event that the downstream pressure requirements to effect the desired rate of ballast exchange are exceeded. Should the pressure in main conduits 18 and 20 fall below a predetermined value due to a change in the ship's speed or its velocity relative to the surrounding sea, valve controllers respond to close one or more valve sets. For example, if the ship were to be placed in an emergency stopping mode, bow intake valves 12 are closed in order to maintain the contents of the ballast tanks. Any necessary reduction in the contents of the individual tanks can be made using the ships conventional piping and valves.

Figure 3:
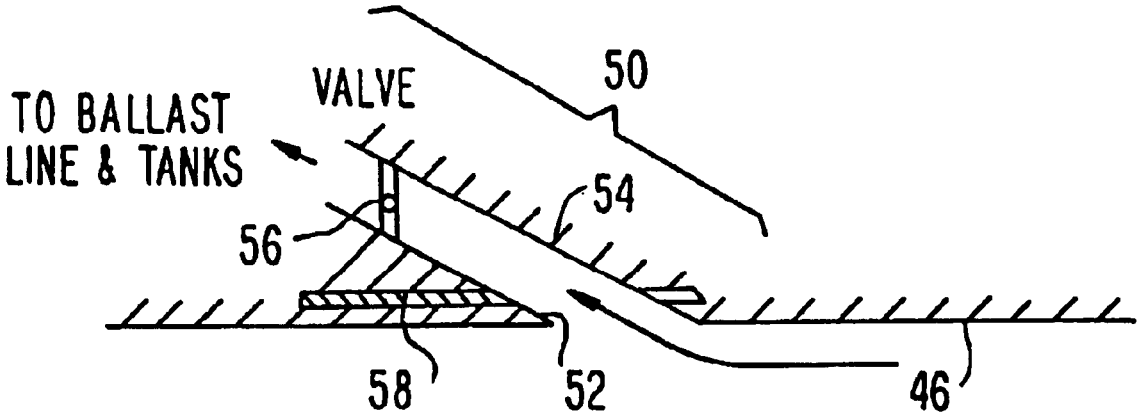
FIG. 3 is an enlarged side elevation view in cross-section of a portion of a marine vessel's hull schematically illustrating another preferred embodiment of the invention.

With reference to FIG. 3, there is shown an alternative embodiment in which a scoop 50 is incorporated into the hull's exterior shell plate 46. The scoop assembly 50 includes bottom orifice 52 intake conduit 54 and intake control valve 56. As was the case with the bow intake openings, while the ship is underway, the hydrodynamic force of the relative movement of the vessel through the sea is sufficient to cause the seawater to flow into and through the intake conduit 54 and into the distribution system. Intake control valve can be closed to prevent the flow of incoming seawater or the release of ballast water in the event that the ship's speed is insufficient to maintain the desired height of the ballast water. The scoop assembly 50 can also include a door or hatch 58 that can be moved into position to close and seal the intake opening 52.

Figure 4:
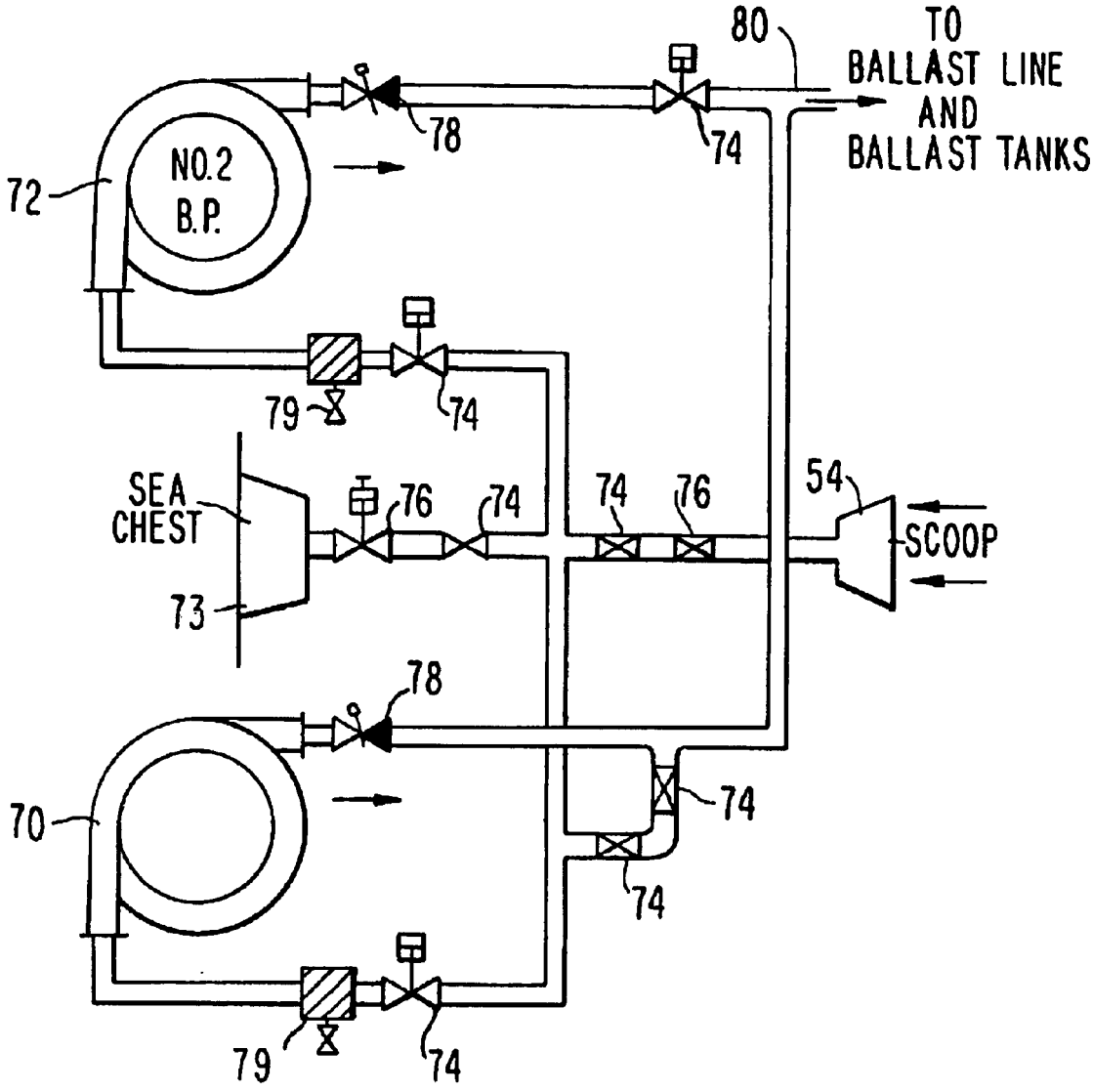
FIG. 4 is a schematic illustration of a portion of one preferred embodiment of a ballast intake and control system for use with the embodiment of FIG. 3.

Referring now to FIG. 4, a schematic of the related piping, valves and pumps downstream of the scoop assembly 50 is provided. In this embodiment, two ballast pumps 70 and 72 are provided to ensure operability in the event of a breakdown or scheduled maintenance of one of the pumps. The arrangement of the piping and valves downstream of the scoop assembly 50 can be provided in accordance with systems established for distribution of ballast water known to the prior art. In the particular embodiment illustrated, the valves identified as 74 are butterfly valves, those identified as 76 are gate valves and valves 78 are check valves. Also illustrated upstream of each of the ballast pumps 70, 72 is an optional vacuum stripping canister 79.

In the method of operation, the scoop door 58 is opened so that seawater is admitted through opening 52 and flows through conduit 54 through open intake valve 56. If the pressure is insufficient to cause the incoming sea water to overflow the tops of the ballast tanks, either or both of ballast pumps 70, 72 can be activated to provide the necessary line pressure. As will be understood by one of ordinary skill in the art, the sea water flowing through the conduit 54 can be piped directly to the ballast tanks as in the embodiment of FIG. 1 without passing it through ballast pumps 70, 72. This will reduce frictional losses. In accordance with known constructions, a seachest 73 can provide an additional supply of seawater for the auxiliary ballast pumps 70 and 72.

In a further preferred embodiment, at least one additional scoop assembly 50 is provided at a forward location closer to the bow of the ship in order to reduce the number of fittings and length of the conduit through which the incoming seawater must flow before reaching the ballast tanks. Appropriate valving and pipes are installed to provide connections to the intake port of each of pumps 70, 72.

The size, positioning and configuration of the scoop or scoops of this embodiment are readily determinable by one of ordinary skill in the art based upon the flow requirements and hydrostatic head to be provided in order to assure an overflow condition in each of the vessel's ballast tanks. As noted above, the flow of incoming seawater through the scoop can also be connected to the vessel's existing ballast pumps in order to provide additional pressure to achieve the desired overflow conditions.

Figure 5:
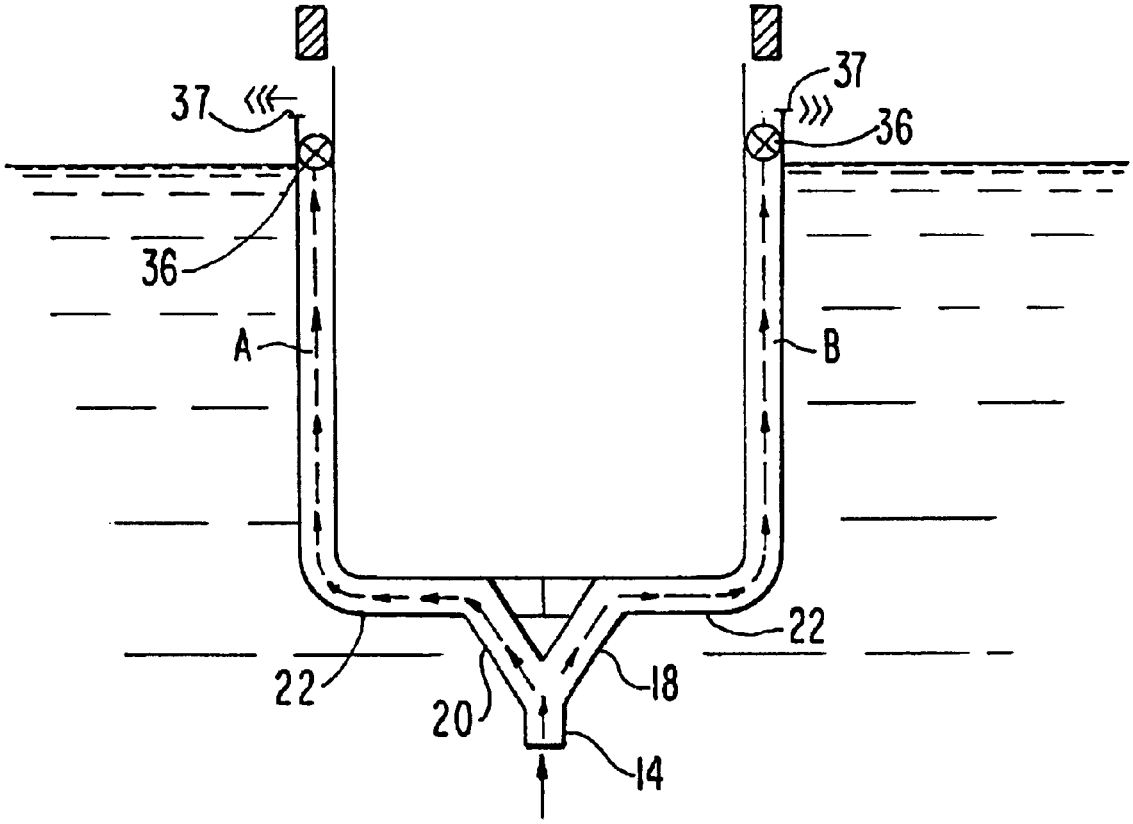
FIG. 5 is a cross-section end view of a vessel fitted with the invention of FIG. 3, schematically illustrating the flow of bilge replacement water.

As shown in schematic illustration of FIG. 5, representing a cargo vessel at sea, the majority of the hull is below the level of the sea. Assuming that the port and starboard ballast tanks A and B are in fluid communication with the surrounding sea, the ballast water will be at substantially the same height inside the ship's double hull as the seawater on the outside of the hull. In this configuration, the hydrodynamic forces of seawater admitted through the one or more inlet ports combines with the existing static pressure of the water in the ballast tanks to effect the desired exchange.

As will be apparent to one of ordinary skill in the art, the rate at which the water is changed in the vessel's ballast tanks will depend upon a number of variable factors, including the diameter of the intake pipes, speed of the vessel, capacity of auxiliary ballast water pumps, if required, and the like. The determination of these variables and the necessary calculations required to effectuate the practice of the method and apparatus of the invention in a particular ship and under specific operating conditions are well within the ordinary skill of those working in the art.

I claim:

1. A method for replacing ballast water in a ballast tank of a ship while the ship is underway in the sea comprising the steps of:

providing a seawater inlet port in the bow of the ship when the ship is moving through the sea at a pressure that is greater than the pressure of the ballast water that is to be replaced, the pressure being measured in a bottom region of the tank;

directing the pressurized seawater from the inlet port into the bottom portion of the ballast tank;

discharging water into the sea from at least one outlet port located in a top portion of the ballast tank.

2. The method of claim 1, wherein the ballast water is discharged through a plurality of outlet ports at the top portion of the ballast tank.

3. The method of claim 1, wherein the pressurized sea water is distributed along the bottom of the ballast tank.

4. The method of claim 3, wherein the seawater is directed into the ballast tank through a single opening in a wall of the tank.

5. The method of claim 3, wherein the seawater is directed into the ballast tank through a plurality of openings in a wall of the tank.

6. The method of claim 1 which comprises the further steps of:

measuring the flow rate of discharge of seawater from the at least one outlet port;

continuing the discharge of seawater from the at least one outlet port for a predetermined time that is based on the flow rate;

terminating the flow of water into the bottom portion of the ballast tank; and closing the at least one outlet port to seal the tank.

7. The method of claim 6, wherein the discharge is continued for a time that is sufficient to effect a predetermined minimum effective exchange of replacement seawater with ballast water that is to be replaced.

8. The method of claim 7, wherein the effective exchange is at least eighty percent.

9. The method of claim 6 which includes directing water to another ballast tank on the same ship.

10. A method for dynamically replacing the ballast water in a plurality of separate ballast tanks in a ship moving through the sea comprising the steps of:

a. providing a seawater inlet port in the bow of the ship when the ship is moving through the sea at a pressure that is greater than the pressure of the ballast water that is to be replaced, the pressure being measured in a bottom region of the tanks;

b. directing the pressurized seawater from the inlet port into the bottom portion of the ballast tanks; and c. discharging water from at least one outlet port located in a top portion of the ballast tanks and into the sea.

11. The method of claim 10, wherein the pressurized seawater is introduced into more than one tank simultaneously.

12. Apparatus for dynamically exchanging the ballast water in a ship having a plurality of ballast tanks while the ship is moving through the sea, the apparatus comprising:

a. a submerged seawater inlet port located in the hull of the ship;

b. at least one main conduit in fluid communication with the inlet port;

c. at least one feedline extending from a lower portion of each of the plurality of ballast tanks for which a dynamic ballast to exchange is to be effectuated, and in fluid communication with the at least one main conduit;

d. at least one outlet port located at the top of each of the plurality of ballast tanks, said outlet ports being provided for the discharge of water from inside the plurality of ballast tanks into the sea, whereby seawater admitted into the inlet port flows into the lower portion of the plurality of ballast tanks, the water in the ballast tanks being discharged through the respective outlet ports.

13. The apparatus of claim 12 which further comprises at least one protective door for covering the inlet port.

14. The apparatus of claim 12 which further comprises at least one valve positioned to interrupt the flow through each of the at least one main conduits.

15. The apparatus of claim 12 which further includes at least one valve on each of the feedlines to the ballast tanks.

16. The apparatus of claim 12 which further includes at least one valve to interrupt the flow of water through the at least one outlet port at the top of the plurality of ballast tanks.

17. The apparatus of claim 12 which further comprises a distribution manifold for directing water from the feedline throughout the bottom potion of each of the ballast tanks.

18. The apparatus of claim 12, wherein a main conduit passes through the walls of the plurality of ballast tanks.

19. The apparatus of claim 12, wherein the at least one inlet port is located in the bow of the ship.

20. The apparatus of claim 19, wherein the at least one main conduit extends aft from the bow inlet port.

21. The apparatus of claim 20, wherein two main conduits extend longitudinally from the bow on either side of the ship's keel line.

22. The apparatus of claim 12 where the at least one inlet port is a scoop located in the bottom of the hull.

23. The apparatus of claim 22 further comprising at least one auxiliary ballast pump in fluid communication with the at least one main conduit and the at least one ballast feedline, whereby the hydrodynamic pressure in the ballast tanks can be increased by actuating the at least one auxiliary pump.

24. The apparatus of claim 23 further comprising a sea chest fitted into the ship's hull, the sea chest in fluid communication with the auxiliary ballast pump.

25. The apparatus of claim 22, wherein two scoops are located at fore and aft positions in the bottom of the hull.

* * * * *